United States Patent [19]

Fontana et al.

[11] 3,962,512

[45] June 8, 1976

[54] COMPOSITE LAMINAR STRUCTURE AND RELATIVE MANUFACTURING PROCESS

[75] Inventors: Marco Fontana; Bruno Borca, both of Milan, Italy

[73] Assignee: Industrie Pirelli S.p.A., Milan, Italy

[22] Filed: Dec. 23, 1974

[21] Appl. No.: 536,952

Related U.S. Application Data

[63] Continuation-in-part of Ser. No. 352,219, April 18, 1973, abandoned.

[30] Foreign Application Priority Data

May 22, 1972 Italy ..... 24655/72

[52] U.S. Cl. ..... 428/290; 427/366; 427/370; 428/310; 428/317; 428/425; 428/904

[51] Int. Cl.[2] ..... B32B 17/02; B32B 27/40

[58] Field of Search ..... 428/15, 290, 310, 317, 428/473, 540, 904, 425; 427/366, 370, 389

[56] References Cited

UNITED STATES PATENTS

| | | | |
|---|---|---|---|
| 1,533,273 | 4/1925 | Respess | 117/65.2 |
| 2,772,995 | 12/1956 | Wilson | 428/297 |
| 2,973,284 | 2/1961 | Semegen | 428/290 |
| 3,238,055 | 3/1966 | Brightwell | 428/227 |
| 3,282,039 | 11/1966 | Geyer et al. | 57/164 |
| 3,346,445 | 10/1967 | Gay | 117/140 |
| 3,384,506 | 5/1968 | Elkin | 427/377 |
| 3,483,015 | 12/1969 | Fukushima et al. | 428/904 |
| 3,595,732 | 6/1971 | Tingerthal | 428/304 |
| 3,694,301 | 9/1972 | Gruenwald et al. | 428/292 |

*Primary Examiner*—William J. Van Balen
*Assistant Examiner*—Paul J. Thibodeau
*Attorney, Agent, or Firm*—Stevens, Davis, Miller & Mosher

[57] ABSTRACT

A non-woven fabric having a fibrous surface similar to that of leather and high mechanical characteristics so that it is adapted for use as a substitute for leather in industrial applications is prepared by saturating a matt of fibers with an elastomeric polyurethane which can be cross-linked with moisture. The so obtained composite laminar structure, having a thickness of from 0.1 to 10 mm, has a density of about 0.85 to 1.4 g/cm$^3$, a hardness of 85 to 95 Shore A and a tensile strength of about 1.5 to 2.5 kg/mm$^2$, and possesses a water-vapor permeability in the range of about 30 to 100 g/m$^2$/24 hours according to DIN 53 333.

6 Claims, No Drawings

COMPOSITE LAMINAR STRUCTURE AND RELATIVE MANUFACTURING PROCESS

This application is a Continuation-in-Part application of Ser. No. 352,219 filed Apr. 18, 1973 now abandoned.

The present invention relates to a composite laminar structure having a fibrous surface and consisting of a layer of non-woven fabric comprising artificial and/or synthetic fibers totally saturated with an elastomeric polyurethane, which is particularly suitable for making accessories for machinery used in the textile industry, such as rubbing aprons for carding machines, high draft aprons, aprons for intersecting gill-boxes and similar annular elements.

It is known that non-woven fabrics are widely used as a substrate for structures replacing natural leather. Such fabrics are in general formed of a fleece of synthetic and/or artificial fibers, such as polyamide, polyester or regenerated cellulose fibers, which is carded and then formed into a layer by mechanical means such as, for instance, by needle punching, or by means of a chemical-physical bond, obtained, for instance, by thermal treatment of the fleece.

In order to provide a structure to be used as a substitute for leather, the basic material is usually impregnated with an aqueous dispersion or with a solution of an elastomeric polymer such as natural rubber or polyurethane. The dispersion or solution soaks uniformly into the tangle of fibers forming the nonwoven fabric. After elimination of the liquid phase by washing and drying, a composite substrate is obtained in which about 20 to 75 parts of the binder are uniformly distributed with respect to 80 to 25 parts of fibers. In the structure of said substrate, the binder covers practically the fibers of the non-woven fabric, but hollow spaces are still remaining between the so covered fibers, and this preserves good flexibility and yield in the substrate, which characteristics are particularly appreciable for the intended use of the substrate to form artificial leather for peltry articles in general.

The substrate described above may then by subjected to further treatment, covered with one or more layers of elastomeric or plastomeric materials and is finally appropriately finished.

The so impregnated non-woven fabric normally used to replace natural leather has a predominantly fibrous structure, and possesses a relatively low density, of the order of 0.45 to 0.50 g/cm$^3$, just due to the fact that the above indicated hollow spaces exist in its structure.

Such a material has mechanical and surface characteristics quite sufficient to make it suitable as a substitute for natural leather in peltry articles, as gloves and uppers, but not for industrial uses, as accessories of machinery of textile industry. In fact, said particular type of article must have well specific surface characteristics and high mechanical characteristics to ensure a correct treatment of textile material. In particular, as regards its surface characteristics, the article must have a surface of fibrous type, so as to exert with respect to the textile material to be treated a particular friction, able to maintain it adherent against its surface for the time necessary for the treatment, without anyhow retaining it against its surface when the treatment is over. Moreover, the article must possess the capacity of absorbing water vapour, since it is used in damp rooms; if it had not said surface characteristic, a condensation of water vapor would take place on its surface, and it, more or less intense, would prejudice the correct and constant treatment of the textile material by the article.

The non-woven fabric impregnated with elastomeric or plastomeric materials as mentioned above has a capacity of absorbing water vapour which is useful for the above indicated purposes; however, being it not completely saturated by the elastomeric or plastomeric material, it has insufficient mechanical characteristics and a surface which shows irregularities due both to the ends of the fibers protruding from the structure and to the non-continuity of the elastomeric or plastomeric material in proximity of the surface itself. Therefore, the so impregnated non-woven fabric, besides not having the required mechanical resistance, inextensibility and wear resistance, possesses too high friction characteristics, which do not permit the detachment of the treated textile material. On the other hand, it is impossible to improve the mechanical characteristics and the friction characteristics by producing a non-woven fabric having a high density, i.e. a content of elastomeric or plastomeric material so high as to fill all hollow spaces between the fibers, both inside the structure and at its surface, by conventional methods of impregnation with latices or solutions of high polymer content. In fact, the polymers which are normally used for impregnation are extremely viscous and will not penetrate completely within the matt of fibers constituting the structure of the non-woven fabric unless they are strongly diluted. This means that, even by resorting to several successive impregnation operations with said latices or solutions, the elimination of the high content of solvent or water of the impregnating bath in the structure of the non-woven fabric with long and elaborate drying post-treatments originates unavoidable hollow spaces inside the structure and on its surface, which are detrimental for the required physical and mechanical characteristics in view of the above specified industrial purposes.

The Applicants have now found that it is possible to provide a non-woven fabric which has in its structure an elastomeric content so high as to possess very good mechanical characteristics and to show a surface having friction characteristics quite similar to those of natural leather, maintaining however a water-vapour permeability of a quite appreciable level for industrial purposes.

Such a structure is therefore an advantageous alternative to natural leather, in a field where leather was considered heretofore as unreplaceable.

It is therefore an object of the invention to provide a non-woven fabric impregnated with an elastomeric polyurethane which has surface characteristics resembling those of natural leather and mechanical characteristics comparable to those of leather.

Another object of the invention is to provide a method for making a non-woven fabric impregnated with elastomeric polyurethane which can be used as a substitute for leather in industrial applications.

The foregoing objects and others are accomplished in accordance with the invention by providing a composite laminar structure having a fibrous surface and a thickness between about 0.1 to 10 mm, comprising at least a non-woven fabric of polyamide, polyester or regenerated cellulose fibers totally saturated with a cross-linked microcellular polyurethane elastomer having prevailingly closed cells, whereby the composite laminar structure has a density of about 0.85 to 1.4 g/cm³, a hardness ranging between about 85 and 95 Shore A and a tensile strength of about 1.5 to 2.5 kg/mm² and has a watervapour permeability in the range of about 30 to 100 g/m²/24 hours according to DIN 53 333. The invention also provides a process for making such a composite laminar structure comprising the steps of :

coating at least one surface of at least a matt of polyamide, polyester or regenerated cellulose fibers, having an apparent density between 0.10 and 0.60 g/cm³, a hardness of about 45 Shore A, a tensile strength between 0.8 and 1 kg/mm², and a thickness of from about 0.2 to 25 mm, with a moisture crosslinkable urethane composition, having a viscosity at room temperature ranging between 8,000 and 60,000 centipoises, said urethane composition being based on an urethane prepolymer having from 1.5 to 4.5% of free isocyanate groups, said prepolymer being prepared by reacting a polyol, having preferably two terminal hydroxyl groups and a molecular weight comprised between 1,500 and 2,500, with an excess of an organic aromatic or cycloaliphatic diisocyanate, pressing said coated matt whereby the urethane composition penetrates the matt,and continuing said pressing operation until the urethane prepolmer expands and is at least partially cross-linked, whereby avoiding that at least the larger part of carbon dioxide bubbles generated by reaction of free isocyanate groups of said urethane prepolymer with moisture from the air develop from the inside of the so obtained composite laminar structure.

The composite laminar structure may be finished by conventional finishing operations.

The composite laminar structure having a fibrous surface and possessing the above indicated physical and mechanical characteristics is quite suitable to be used as a total substitution for natural leather, to form annular elements for machinery of the textile industry, such as high draft aprons, rubbing aprons for carding machines, aprons for intersecting gill-boxes, aprons for converters and aprons for drawing heads.

Moreover, the material is obtained by means of a process which involves only simple steps and requires only conventional equipment. Hence, it is extremely advantageous from an economical point of view.

In practicing the process of the present invention, the non-woven fabric is a layer of non-woven fibers, at least partially synthetic, such as polyamide or polyester fibers and optionally fibers of regenerated cellulose. The layer of non-woven fibers can be of the type in which the fibers are connected together by needle punching or are bonded by means of a chemical-physical treatment, either during the spinning phase (the so-called "spun bonded" fibers) or by a short thermal treatment subsequent to the formation of the layer.

The layer of non-woven fabric, having a thickness ranging between 0.2 and 25 mm, can be subjected, as it is, to the coating with the cross-linkable urethane composition, especially if said layer is of the above defined "spun bonded" type. However, it is preferred to use a layer of non-woven fabric which has already been subjected to a preliminary impregnation with an aqueous dispersion or solution of an elastomer or plastomer, followed by a conventional drying treatment in order to eliminate totally the impregnating liquid phase. A layer of non-woven fabric impregnated in this way has in general a density ranging between 0.10 and 0.60 g/cm³; its hardness is equal to about 45 Shore A and its tensile strength is between 0.8 and 1 kg/mm².

The layer of non-woven fabric which has been subjected to said preliminary impregnation is coated on at least one surface with a urethane composition of the type cross-linkable by moisture, having a viscosity ranging between 8,000 and 60,000 centipoises. Such a composition may be made by conventional processes, using as initial products a polyol, preferably having two terminal hydroxylic groups and a molecular weight from 1,500 to 2,500 and an organic diisocyanate in excess, in such a stoichiometric ratio that the resulting prepolymer contains from 1.5 to 4.5% of free isocyanate groups. The polyurethane is formed by the subsequent cross-linking of the prepolymer through its free isocyanate groups.

As polyols suitable for the production of said urethane prepolymer, linear polyesters having two terminal hydroxyl groups, obtained by reaction of adipic acid with glycols, or polycarprolactones, or also polyethers, preferably poly-tetramethylenglycol can be used. As organic diisocyanate, aromatic or cycloaliphatic compounds are to be used, such as toluilen-diisocyanate, diphenylmethane-diisocyanate and dicyclo-hexyl-methane-di=isocyanate.

A very important feature of this urethane composition is the concentration of the prepolymer, since this has a direct effect on the density of the composite laminar structure to be formed.

In other words, the urethane composition must contain a minimum amount of volatile substances.

In a preferred embodiment of the process of the present invention, a urethane composition is used, which consists only of the urethane prepolymer, and which has a viscosity, at room temperature, ranging between 10,000 and 60,000 centipoises.

In another embodiment of the process, a solution of a urethane prepolymer in which a solvent is present in an amount not exceeding 10% with respect to the prepolymer is used. In that case, the urethane composition has a viscosity at room temperature ranging between 8,000 and 40,000 centipoises.

The solvent used may be selected between methyl-ethylketone, ethyl-acetate, tetrahydrofurane, dimethylformamide.

After coating, the layer of non-woven fabric is pressed.

The result of this operation is that the urethane composition, although it is highly viscous, penetrates perfectly into the fibrous matt, saturating it totally, namely filling completely the hollow spaces existing between the fibers, both inside them and at their surface, so that the finished article shows a surface irregularity due only to the free ends of the fibers protruding on the surface itself. The operation is continued for a time sufficient to obtain the expansion and at least a partial cross-linking of the urethane composition, so that at least the larger part of carbon dioxide bubbles, which are generated by reaction of free isocyanate groups of the urethane prepolymer with moisture from the air, do not develop from the inside of the resultant composite structure. In this way, it is avoided that the polyurethane elastomer penetrated inside the non-woven fabric in consequence of pressing and filling all the hollow spaces between the fibers may have on its turn hollow spaces of appreciable dimensions (generated by the gas bubbles developed in the reaction), with a consequent reduction of the density of the composite laminar structure and relevant loss of the mechanical and physical characteristics which it is wished to impart to said type of article.

As the bubbles of carbon dioxide remain inside the structure, at least during the pressing operation, the composite laminar structure resulting in accordance with the above process will be completely saturated with an elastomeric polyurethane of microcellular type, namely having very small and closed cells (therefore not intercommunicating, as in the case of synthetic leather possessing high breathability characteristics, suitable for peltry, obtained according to the known processes of impregnation of non-woven fabric with polyurethanes). Said bubbles of carbon dioxide will disappear, at least partially, in the finished article, by slow diffusion through the walls of the fine and closed cells of the composite structure; it is anyhow evident that this does not affect in any way the microcellular structure as it is obtained according to the process forming the object of the present invention.

The composite laminar structure so obtained, besides showing a fibrous surface typical of natural leather, has a high density, comprised between a minimum of 0.85 and a maximum of 1.4 g/cm$^3$, and possesses very good mechanical characteristics, among which the tensile strength, comprised between 1.5 and 2.5 kg/mm$^2$, and the hardness ranging between 85 and 95 Shore A, are the most relevant. In spite of the complete saturation of the hollow spaces of the structure of the non-woven fabric by polyurethane and of the closed cell structure of polyurethane, the obtained product still possesses appreciable characteristics of water-vapour permeability. In fact, it has been ascertained that it has a water-vapour permeability in the range of about 30 to 100 g/m$^2$/24 hours according to DIN 53 333; these values, although much lower than those obtained on synthetic leather formed by non-woven fabrics impregnated with polyurethane and usually suitable for peltry, are quite appreciable for the industrial purposes for which the article in question is intended.

The achievement of the composite laminar structure according to the present invention depends also on the thickness of the basic layer of non-woven fabric.

In other words, the maximum thickness of the non-woven fabric to be coated with the urethane composition, established in 25 mm, is critical, since otherwise the pressing operation is unable to ensure that the whole thickness of the tangle of fibers is compenetrated by the urethane preoplymer coated on its surface. According to an alternative embodiment of the process of the present invention, the operation of coating with the urethane composition is carried out on a plurality of matts of polyamide, polyester or regenerated cellulose fibers, each of said matts having, in this case, a thickness preferably between 0.2 and 3 mm; in the practice, at least one surface of each of said matts is coated and the matts are assembled the one on the other in such a way that at least one layer of said urethane composition is present between one matt and the other. Then the pressing operation is carried out quite analogously to what is done when one individual layer of non-woven fabric is used.

Pressing may be carried out by passing the layer of non-woven fabric coated with the urethane composition or the assembly of the so coated layers continuously between two facing surfaces such as the platens of a press or the belt and cylinder of a continuous curing unit heated at a temperature ranging between 125°C and 175°C.

The operation of pressing lasts in general for a time interval of the order of 20 minutes, sufficient to obtain an appreciable cross-linking of the urethane prepolymer.

It is also possible to apply to the layer of non-woven fabric coated with the urethane composition or to the assembly of the so coated layers the platens of the press without previously heating them, but obviously, a longer time of rest of the unit in the press would be necessary in this case, so that the press cannot be used immediately for another working cycle.

The pressing phase can also be carried out by winding the layer of non-woven fabric or the assembly of the so coated layers under tension on a drum, in two or more turns and allowing the winding to rest, preferably at room temperature, for a time sufficient to obtain at least a partial cross-linking of the urethane prepolymer. In this case the time interval will be at least 24 hours.

The above described winding, applied on the drum, can be subjected to a thermal treatment, with the advantage of reducing the time necessary for the cross-linking of the urethane prepolymer.

When the expansion and at least a partial cross-linking of the urethane prepolymer has been obtained, the winding is subjected, directly on the drum, to cutting operations in order to obtain the composite laminar structure.

In whichever way the pressing step may have been effected, the resulting composite laminar structure is subjected to conventional finishing operations.

As pointed out above, the composite laminar structure having a fibrous surface provided by the invention is particularly well adapted for forming annular elements to be employed as accessories in machinery for the textile industry. To this end, the composite laminar structure is prepared in the most appropriate sizes in specific thicknesses and in pre-established lengths, so that its ends are then joined to form a ring, for instance, by an adhesive agent over the surface and/or hot pressing the adjacent zones.

If desired, the composite laminar structure can be doubled and bonded to layers of elastomeric or plastomeric material to form annular elements of more complex construction.

It is to be borne in mind that the composite laminar structure according to the present invention, having very high physical and mechanical characteristics, and surface features analogous to those of natural leather, can be used to advantage in fields other than those indicated above such as, for instance, in the production of flat driving belts.

The invention will be better understood from the following not-limiting example.

A mole of polyester having two terminal hydroxyl groups, a molecular weight of 2,000, a hydroxyl number equal to 56, an acid value smaller than 1.5 and a water content smaller than 0.05%, obtained by reacting adipic acid with a mixture of ethylene glycol and propylene glycol, the latter being present in the mixture in a proportion of 30%, and preliminarily heated at 70°C, was introduced in a reactor thermostatized at 105°–110°C and was reacted under vacuum with two moles of 4,4′-diphenylmethane-diisocyanate for 130 minutes. The so obtained prepolymer had a 2.6% content of free isocyanate groups and a viscosity of 55,000 centipoises at room temperature. The prepolymer was then soluted in dimethyl-ethylketone, the solvent being present in the solution in an amount of 10% with respect to the prepolymer. The obtained solution was spread on the surface of ten layers of non-woven fabric of polyamide fibers, each layer having a thickness of 0.5 mm and an apparent density of 0.50 g/cm³. The layers, all having a width of 30 cm and a length of 2 m, after coating with the solution of urethane prepolymer, were superimposed to one another in such a way that the treated surface of each layer was in contact with the not treated surface of the next one. The obtained assembly was then placed between the two platens of a press heated at a temperature of 170°C and left there for 20 minutes. The resulting composite laminar structure, after removal from the press, had a fibrous surface and possessed the following physical and mechanical characteristics:

| | |
|---|---|
| thickness | 3.5 mm |
| density | 1.2 g/cm³ |
| tensile strength | 2.4 kg/mm² |
| water-vapour permeability (DIN 53 333) | 50 g/m²/24 hours |
| hardness | 93 Shore A |

The laminar composite structure was then subjected to the operations of longitudinal cutting and finishing to obtain condenser tapes for textile industry machinery. In practice, elements having a thickness of 3.3 mm, a width of 12 mm and a length of about 2 m were obtained, which after solutioning of their ends and hot pressing of said joined ends, originated the condenser tapes.

Although the invention has been described in detail for the purpose of illustration, it is to be understood that such detail is solely for that purpose and that variations can be made therein by those skilled in the art without departing from the spirit and scope of the invention except as it may be limited by the claims.

I claim:

1. A microporous article having a fibrous surface and physical characteristics which adapt it to replace natural leather in industrial applications comprising a non-woven polyamide, polyester or regenerated cellulose fabric saturated with a crosslinked microcellular polyurethane elastomer in which the cells are predominately closed non-intercommunicating cells, said article having a density of from 0.85 to 1.4 g/cm³, a hardness of from 85 to 95 Shore A, a tensile strength of from 1.5 to 2.5 kg/mm² and a water vapor permeability of about 30 to 100 g/m²/24 hours as determined by DIN 53333.

2. A process for making a microporous leather substitute which comprises coating a non-woven polyamide, polyester or regenerated fabric having an apparent density of between 0.1 to 0.6 g/cm³, a tensile strength of 0.8 to 1 kg/m² and a thickness of about 0.2 to 25 mm.

with a moisture cross-linkable polyurethane prepolymer having a viscosity at ambient temperatures of 8000 to 60000 centipoises, said prepolymer having been prepared by reacting an organic polyol having a molecular weight of 1500 to 2500 with an excess of an aromatic or cycloaliphatic diisocyanate and having from 1.5 to 4.5% terminal isocyanato groups, pressing the coated fabric while wet to force the prepolymer into the fabric, and continuing to press the resulting impregnated fabric until after the prepolymer has expanded and is at least partially cross-linked by reaction with moisture from the surrounding air to form a microporous product having predominately closed cells and the physical characteristics set forth in claim 10.

3. The product of the process of claim 2.

4. The process of claim 2, wherein the urethane composition is a solvent free urethane prepolymer having from 1.5 to 4.5% of free isocyanate groups and a viscosity at room temperature ranging between 10,000 and 60,000 centipoises.

5. The process of claim 2, wherein the urethane composition is a urethane prepolymer having from 1.5 to 4.5% of free isocyanate groups dissolved in a solvent therefor, said solvent being in an amount not exceeding 10% with respect to said prepolymer, said composition having a viscosity at room temperature ranging between 8,000 and 40,000 centipoises.

6. In the preparation of synthetic leather, adapted for making annular elements suitable as accessories for machinery used in textile industry, obtained by impregnating a non-woven fabric with a moisture cross-linkable polyurethane elastomer, the improvement which comprises:

coating at least one non-woven fabric having an apparent density between 0.10 and 0.60 g/cm³ and a thickness of from about 0.2 to 25 mm, a hardness of about 45 Shore A and a tensile strength between 0.8 and 1 kg/mm², with a moisture cross-linkable urethane prepolymer containing not more than 10% by weight solvent and having from 1.5 to 4.5 of free isocyanate groups and a viscosity at room temperature ranging between 8,000 and 60,000 centipoises;

pressing said at least one coated non-woven fabric whereby the urethane prepolymer penetrates said fabric;

continuing said pressing operation until the urethane prepolymer expands and is at least partially cross-linked, whereby a non-woven fabric totally saturated by a microcellular polyurethane elastomer having prevailingly closed cells and resembling a leather having a fibrous surface, high mechanical characteristics and a water-vapour permeability in the range of about 30 to 100 g/m²/24 hours according to DIN 53 333 is obtained.

* * * * *

UNITED STATES PATENT AND TRADEMARK OFFICE

CERTIFICATE OF CORRECTION

PATENT NO. : 3,962,512

DATED : June 8, 1976

INVENTOR(S) : Marco Fontana; Bruno Borca

It is certified that error appears in the above-identified patent and that said Letters Patent are hereby corrected as shown below:

Column 3, line 27 - "prepolmer" should read --prepolymer--

Column 5, line 50 - "preoplymer" should read --prepolymer--

The last line of Claim 2 should read "Claim 1"

Signed and Sealed this

Twenty-first Day of September 1976

[SEAL]

*Attest:*

RUTH C. MASON
*Attesting Officer*

C. MARSHALL DANN
*Commissioner of Patents and Trademarks*